US007434497B2

(12) United States Patent
Caravello

(10) Patent No.: US 7,434,497 B2
(45) Date of Patent: Oct. 14, 2008

(54) ADJUSTABLE COMPOUND CUTTERS OR GRIPPERS

(76) Inventor: Paul E. Caravello, 5226 S. Saltese Lake Rd., Greenacres, WA (US) 99016

( * ) Notice: Subject to any disclaimer, the term of this patent is extended or adjusted under 35 U.S.C. 154(b) by 12 days.

(21) Appl. No.: 11/623,263

(22) Filed: Jan. 15, 2007

(65) Prior Publication Data

US 2008/0168870 A1 Jul. 17, 2008

(51) Int. Cl.
*B25B 7/12* (2006.01)
*B25B 7/06* (2006.01)

(52) U.S. Cl. ..... 81/364; 81/372

(58) Field of Classification Search ..... 81/91.1–91.3, 81/343, 344, 364–369, 372, 381
See application file for complete search history.

(56) References Cited

U.S. PATENT DOCUMENTS

| | | | | | |
|---|---|---|---|---|---|
| 128,642 | A | * | 7/1872 | Lyman | 168/45 |
| 160,563 | A | * | 3/1875 | Billings | 30/251 |
| 165,445 | A | * | 7/1875 | Graham | 30/251 |
| 366,605 | A | * | 7/1887 | Pollard | 7/133 |
| 416,500 | A | * | 12/1889 | Robbins | 81/382 |
| 417,790 | A | * | 12/1889 | Postle | 30/252 |
| 563,458 | A | * | 7/1896 | Dillenbach | 30/252 |
| 640,257 | A | * | 1/1900 | Baer | 30/252 |
| 787,414 | A | * | 4/1905 | Walton | 30/190 |
| 793,200 | A | * | 6/1905 | Knight | 7/134 |
| 835,900 | A | * | 11/1906 | Casterlin | 30/193 |
| 847,980 | A | * | 3/1907 | Bowler | 30/189 |
| 896,088 | A | * | 8/1908 | De Celle | 30/252 |
| 908,969 | A | | 1/1909 | De Arment | |
| 1,066,675 | A | * | 7/1913 | Stowell | 30/192 |
| 1,164,981 | A | * | 12/1915 | Bernard | 30/193 |
| 1,572,787 | A | * | 2/1926 | Glee et al. | 30/252 |
| 1,648,984 | A | * | 11/1927 | Enell | 30/252 |
| 1,772,224 | A | * | 8/1930 | Peterson | 81/325 |
| 2,090,228 | A | * | 8/1937 | Porter et al. | 30/252 |
| 2,166,089 | A | * | 7/1939 | Brenner | 29/249 |
| 2,222,744 | A | * | 11/1940 | Gallien, Jr. | 72/392 |
| 2,341,654 | A | * | 2/1944 | Richter | 81/352 |
| 2,436,260 | A | * | 2/1948 | Klenk | 30/239 |
| 2,437,432 | A | * | 3/1948 | Martines | 30/252 |
| 2,469,036 | A | * | 5/1949 | Hart | 30/226 |
| 2,520,905 | A | * | 9/1950 | Borrelli | 30/237 |
| 2,579,272 | A | * | 12/1951 | Ralston | 81/343 |
| 2,655,722 | A | * | 10/1953 | Klenk | 30/252 |
| 3,091,841 | A | * | 6/1963 | Wurzel | 29/229 |
| 3,170,345 | A | * | 2/1965 | Poingt | 72/409.12 |
| 3,210,844 | A | * | 10/1965 | Tontscheff | 30/250 |
| 3,261,243 | A | * | 7/1966 | Ellison | 81/351 |
| 3,273,240 | A | * | 9/1966 | Florian | 30/251 |
| 3,390,455 | A | * | 7/1968 | Florian | 30/251 |
| 3,638,307 | A | * | 2/1972 | Stewart | 30/193 |
| 3,851,389 | A | * | 12/1974 | Swanson | 30/250 |
| 3,885,309 | A | * | 5/1975 | Lund et al. | 30/250 |

(Continued)

*Primary Examiner*—David B Thomas

(57) ABSTRACT

A cutting or gripping tool capable of producing high leverage force using compound linkage and with a wide range of motion using an adjustable rack system that forms an adjustable triangular shape without changing the compound force. The tool is designed such that it could be operated with one hand to cut a material with successive squeezing of the handles. It embodies an automatic or manual adjustment to a desired opening with linkage that amplifies the mechanical force of the handles. Its uses include but are not limited to: cutting animal hooves, pruning branches, gripping/cutting bolts and clamping objects.

20 Claims, 4 Drawing Sheets

U.S. PATENT DOCUMENTS 3,915,037 A * 10/1975 Wiener ..... 81/9.43
4,084,317 A * 4/1978 Nakamura et al. ..... 30/94
4,094,064 A * 6/1978 Nishikawa et al. ..... 30/92
4,130,938 A * 12/1978 Uhlmann ..... 30/192
4,144,737 A * 3/1979 Izraeli ..... 72/409.11
4,176,450 A * 12/1979 Muromoto ..... 30/92
4,178,682 A * 12/1979 Sadauskas ..... 30/250
4,221,048 A * 9/1980 Parramore ..... 30/135
4,312,127 A * 1/1982 Tanaka ..... 30/92
4,674,184 A * 6/1987 Anderson ..... 30/92
4,696,107 A * 9/1987 Held ..... 30/246
4,899,445 A * 2/1990 Erbrick et al. ..... 30/251
5,046,250 A * 9/1991 Huang ..... 30/92
5,184,404 A * 2/1993 Chen ..... 30/250
5,245,755 A * 9/1993 Krivec ..... 30/189
5,307,565 A * 5/1994 Erbrick et al. ..... 30/251
5,427,004 A * 6/1995 Monaco ..... 81/91.3
5,511,314 A * 4/1996 Huang ..... 30/251
5,715,604 A * 2/1998 Lanzoni ..... 30/192
5,761,815 A * 6/1998 Lin ..... 30/251
6,000,307 A * 12/1999 Aamodt ..... 83/13
6,227,081 B1 * 5/2001 Bally et al. ..... 81/389
6,389,936 B1 * 5/2002 Domenge ..... 81/418
6,513,248 B2 * 2/2003 Linden et al. ..... 30/251
6,540,027 B2 * 4/2003 Litzen et al. ..... 168/48.1
6,829,828 B1 * 12/2004 Cech et al. ..... 30/250
6,941,844 B2 * 9/2005 Hile ..... 81/368
7,134,365 B2 * 11/2006 Hile ..... 81/368
2005/0279195 A1 * 12/2005 Hile ..... 81/368
2006/0272458 A1 * 12/2006 Kelly ..... 81/367
2007/0283791 A1 * 12/2007 Engvall et al. ..... 81/367

* cited by examiner

FIG 3
FIG 3A
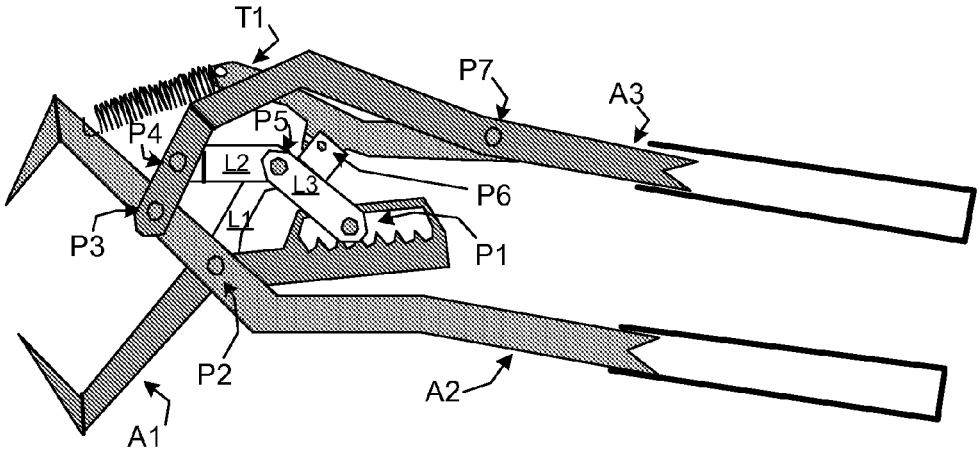
FIG 3B
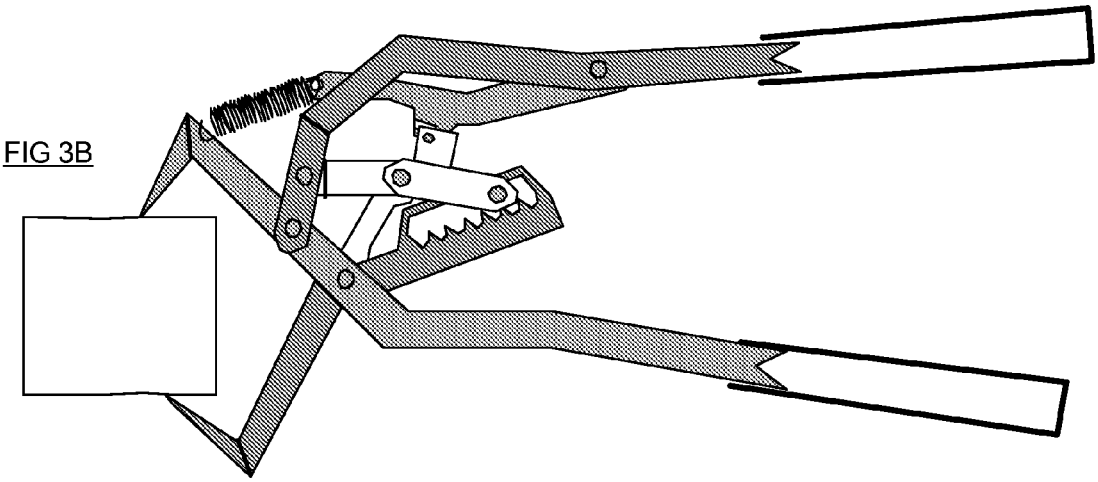
FIG 3C
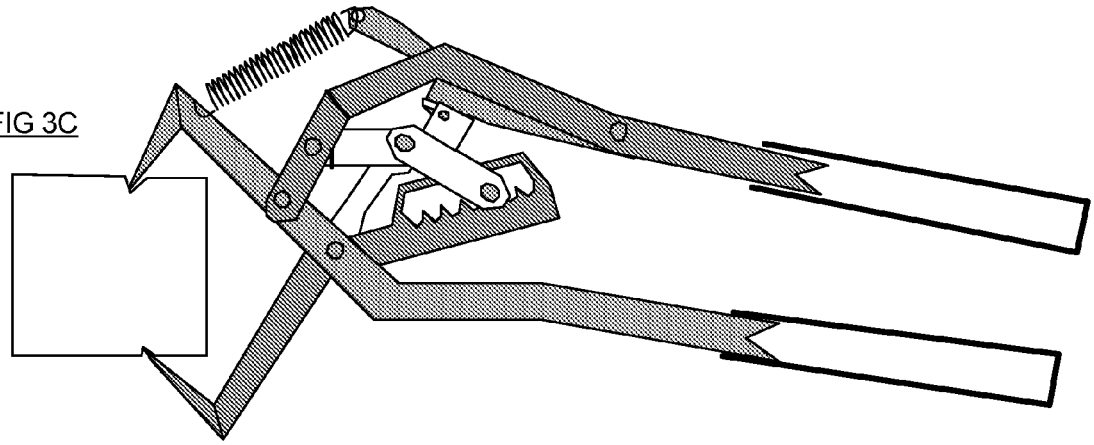

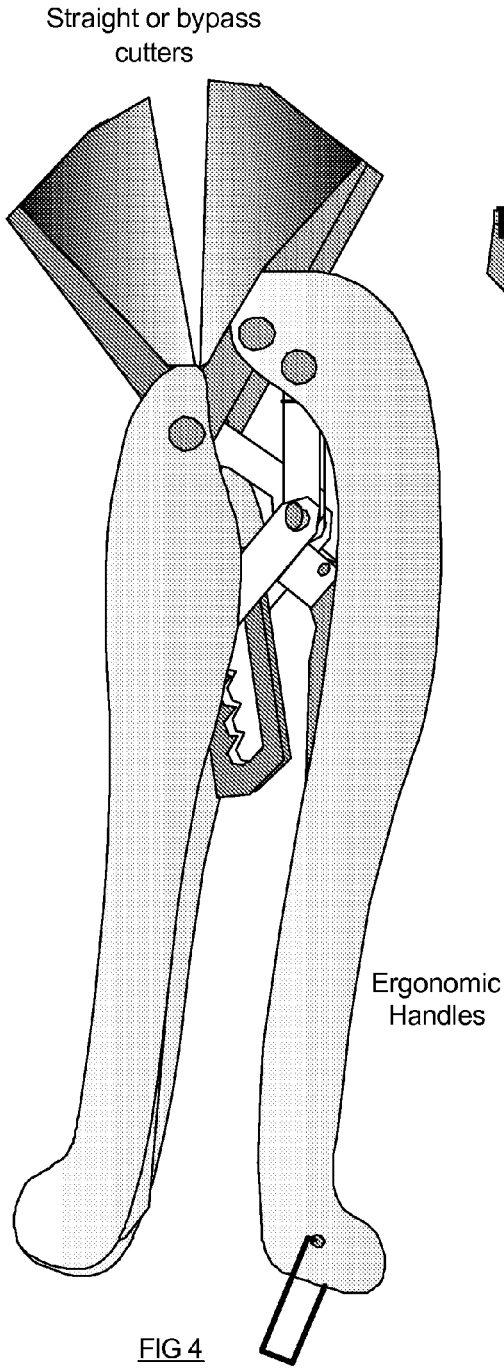
FIG 4
FIG 8
Animal hoof cutter
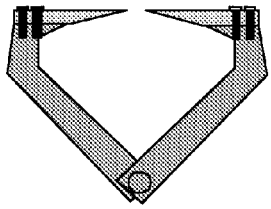
FIG 9
Blade and anvil
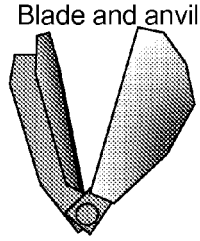
FIG 6
Clamping pliers
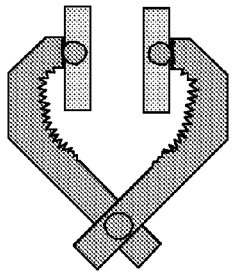
FIG 7
Gripping pliers
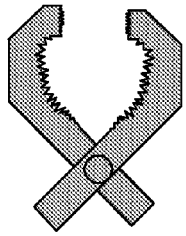
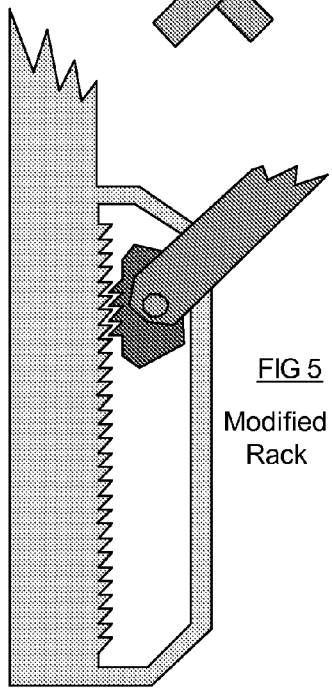
FIG 5
Modified Rack

ADJUSTABLE COMPOUND CUTTERS OR GRIPPERS

BACKGROUND OF THE INVENTION

This invention pertains to a method and tool for cutting, gripping or clamping a variety of materials.

A number of different utility tools are commercially available for a variety of cutting or gripping jobs. Many designs have been made using levers, cams and gears to compound the force exerted on the handles to the cutters or jaws of the tool, (see referenced patent nos.).

SUMMARY OF THE INVENTION

An object of this invention is to provide a new and useful method for cutting or gripping a variety of materials while also providing a mechanical advantage for leverage with a minimal effort or gripping force.

This invention has a means for compounding the leverage and closing the jaws with successive squeezing of the hand levers and instantly releasing the jaws when the handles are released enabling one hand usage. The compound force also remains relatively constant enabling a person with less grip strength to cut through or grip very hard materials.

The above and other objects and attendant advantages of the present invention will be more readily apparent to those skilled in the art from a reading of the following detailed description in conjunction with the accompanying drawings. The drawings show one preferred embodiment of the invention for illustration purpose only but not for limiting the scope of the same in any way.

BRIEF DESCRIPTION OF THE SEVERAL VIEWS OF THE DRAWINGS

FIG. 3 has 3 positions to show how the tool and its components interact and move when being used.

FIG. 4 shows some ergonomic handles with straight or bypass cutters and return spring with tension arm hidden inside of handles FIG. 5 shows how a rack system could look with two intermeshing racks for smoother adjustments.

FIG. 6,7,8,9 show different jaws for the tool

DETAILED DESCRIPTION OF THE INVENTION

To significantly increase the force multiplication the travel distance of the handles has to greatly surpass the travel distance of the cutters or jaws. This results in a very small usable cutting or gripping opening size compared to the handle opening size. Ratcheting type mechanisms have been devised that help alleviate this problem but they have been cumbersome and not easily released if needed. Adjustable rack systems have also been devised, but as the rack adjusts the mechanical leverage changes. Sliding fulcrums also experience the leverage change. This invention uses an adjustable rack system to change the shape of a triangle shape without changing the pivot points of the leverage system thus with no change in mechanical leverage.

Figure 1:
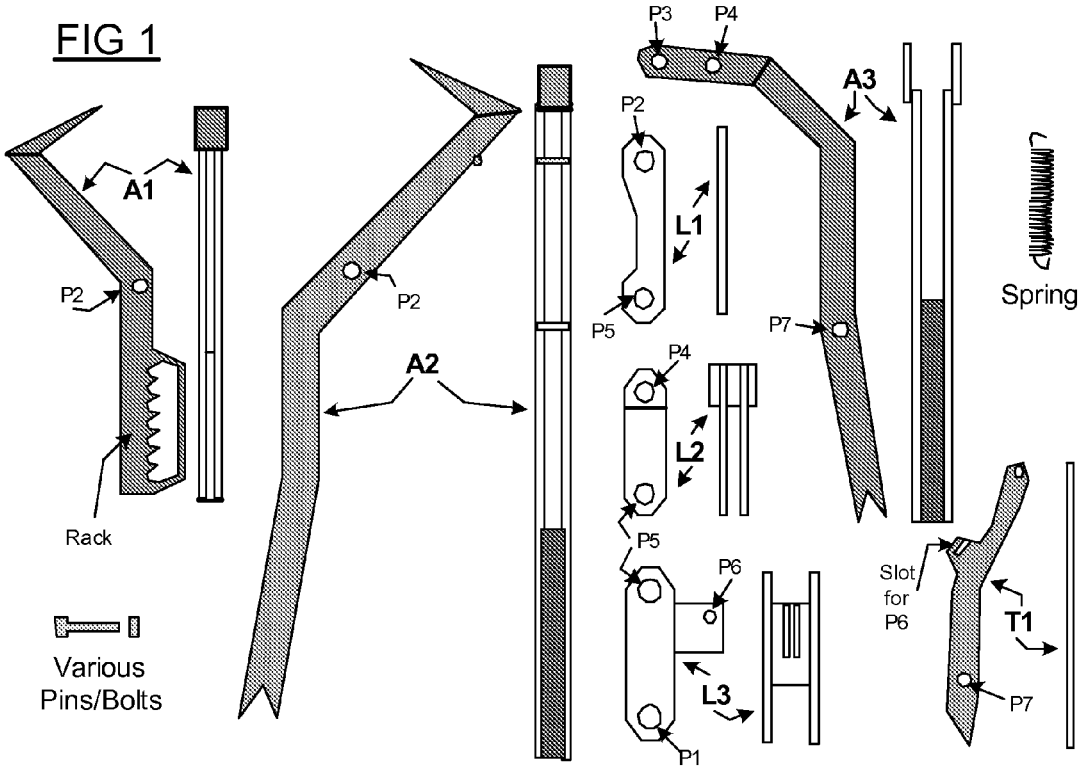
FIG. 1 identifies the parts that make up the preferred embodiment for illustrative purposes. There are front and side-views showing the holes where pivot points will be and the layers of metal in each part.
Figure 2:
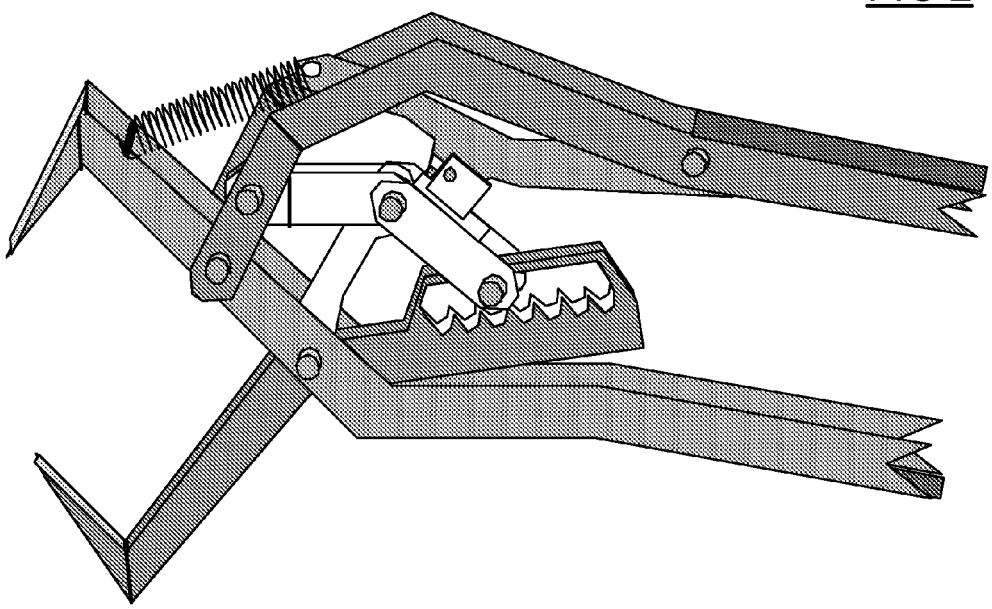
FIG. 2 shows a three dimensional view of how the parts fit together.
Figure 10:
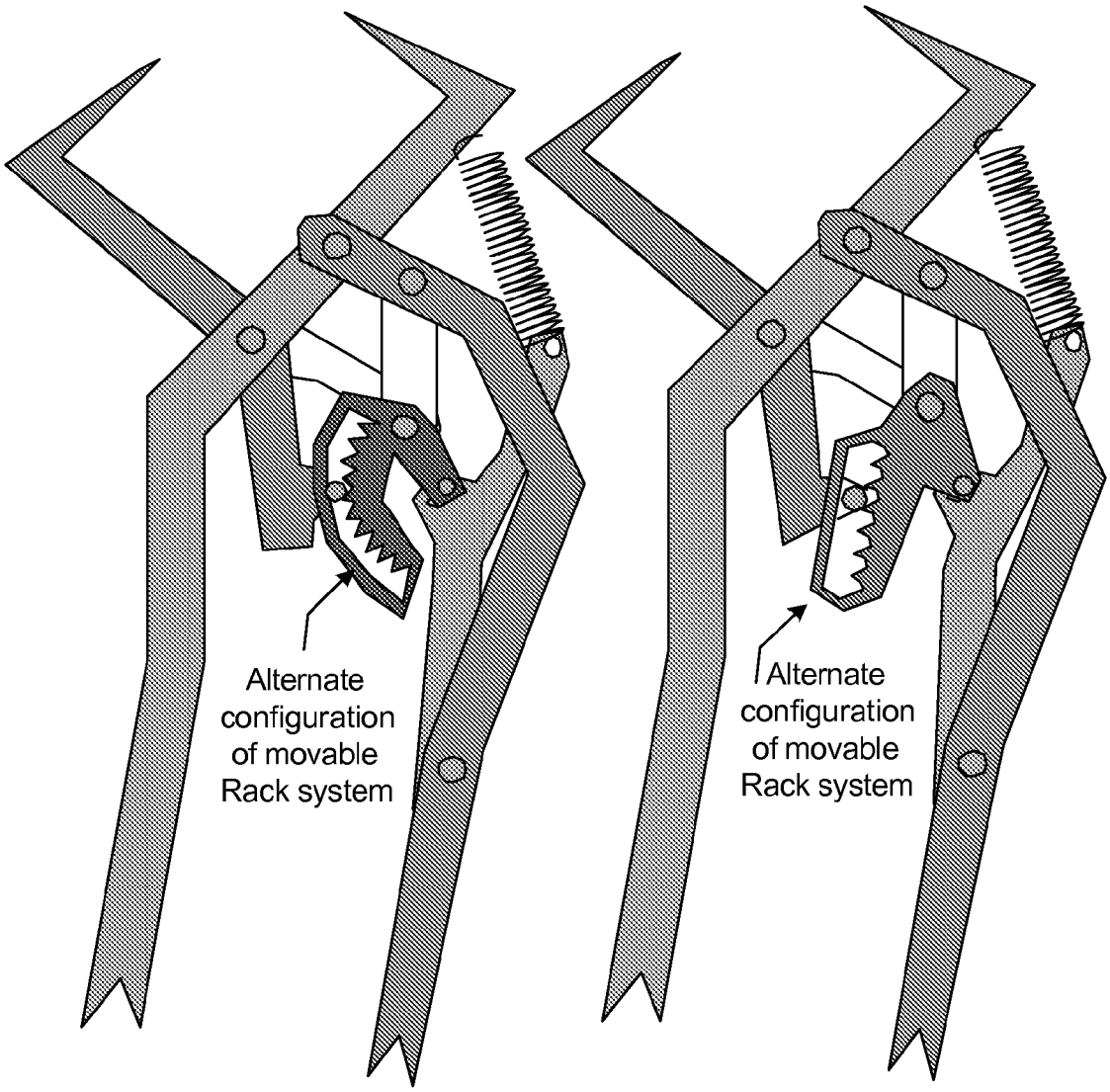
FIG. 10 shows two alternate configurations with the rack being movable and rotating to adjust Jaw opening.

FIG. 1 shows the parts for this embodiment described as follows.

A1: One half of the jaws including pivot point P2 and Rack. Two layers of metal with an opening around pivot point P2 where Link L1 fits between the two layers of metal.

A2: One half of the Jaws including pivot point P2 and Handle. Two layers of metal with an opening around pivot point P2 where A1 fits between the two layers of metal.

L1: Single layer of metal with two holes that connect P2 and P5.

L2: Two layers of metal with added layers at one end to fit inside of A3 at P4 and the other end to allow L1 to fit inside while fitting inside of L3 at pivot point P5.

L3: Two layers of metal joined by a capping piece with two layers attached to it for the Tension Arm, T1, to interact with at pivot point P6. The two main layers are spaced such that one end encompasses L2 and L1 at P5 and the other end fits over the Rack at P1.

A3: Two layers of metal with wider opening at P3 and P4 to encompass L2 and A2. At pivot point P7, T1 is attached inside and allowed to move in one direction but not the other because of the shape of the handle and positioning or P7.

T1: Tension Arm for automatic adjustment, a single layer of metal with a hole for the spring and pivot point P7. A slot is also provided for Pivot point P6 to attach to and slide in.

Reference FIG. 3A, from the points P1 to P2 to P5 a triangle is created that adjusts from an obtuse to an acute triangle. It is this adjusting triangle that allows a wide range of Jaw motion but retains the compound forced needed when there is resistance at the Jaws. The triangle can change shape but the mechanical compounding force remains relatively unchanged. This compound force is relational and is mostly determined by the distance between P3 to P4 compared to the distance between P2 to P5. This ratio remains constant through all motions of the tool. The compounding increases slightly as the handles are squeezed closer because the angle created by P3,P4,P5 becomes more obtuse thus increasing the mechanical leverage. In a cutting tool, this increase is available where most needed, the final stages of cutting through a material.

The Tension Arm, T1, is pivoted at point P7 inside the handle of A3 such that it can only pivot out of the assembly with tension from the spring creating a force applied to L3 to adjust to a smaller opening of the Jaws. Upon release of the handles T1 will excerpt an opening force on L3 to open the Jaws to their widest by moving P1 to the end of the Rack. This action creates the automatic adjustment for the tool.

FIG. 3 shows a typical movement of parts as the tool would be used.

Reference FIG. 3A, with no resistance to the Jaws, P1 will slide through the rack progressively closing the Jaws as the handles are closed. The spring attached to T1 applies pressure on P6 causing L3 to rotate through the steps on the Rack. Upon releasing the handles the spring causes the handles to separate, this in turn causes T1 to pull on P6 that makes L3 rotate back through the Rack opening the Jaws to their widest point.

Reference FIG. 3B, with resistance at the Jaws, P1 begins to engage with the teeth in the Rack allowing the compound force created by the linkage from points P2, P3, P4 and P5 to continue closing the Jaws.

Reference FIG. 3C, the compound force has now crimped or cut the resistance and with a slight release of the handles, L3 will rotate to make P1 engage in the next step on the Rack.

The Tension Arm, T1, has been rotated back and has tension from the spring to push on P6 and L3 to cause this stepping on the Rack. Progressive squeezing action will cut through, grip or clamp the resistance material as desired.

REFERENCED PATENTS

| |
|---|
| 6,829,828 |
| 6,540,027 |
| 6,513,248 |
| 6,000,307 |
| 5,761,815 |
| 5,715,604 |
| 5,511,314 |
| 5,307,565 |
| 5,245,755 |
| 5,184,404 |
| 5,046,250 |
| 4,899,445 |
| 4,696,107 |
| 4,674,184 |
| 4,312,127 |
| 4,221,048 |
| 4,178,682 |
| 4,176,450 |
| 4,144,737 |
| 4,130,938 |
| 4,094,064 |
| 4,084,317 |
| 3,915,037 |
| 3,885,309 |
| 3,851,389 |
| 3,638,307 |
| 3,390,455 |
| 3,273,240 |
| 3,210,844 |
| 3,170,345 |
| 3,091,841 |
| 2,655,722 |
| 2,579,272 |
| 2,520,905 |
| 2,469,036 |
| 2,437,432 |
| 2,436,260 |
| 2,341,654 |
| 2,222,744 |
| 2,166,089 |
| 2,090,228 |
| 1,772,224 |
| 1,648,984 |
| 1,572,787 |
| 1,164,981 |
| 1,066,675 |
| 896,088 |
| 847,980 |
| 835,900 |
| 793,200 |
| 787,414 |
| 640,257 |
| 563,458 |
| 417,790 |
| 416,500 |
| 366,605 |
| 165,445 |
| 160,563 |
| 128,642 |

The invention claimed is:

1. A tool assembly comprising:

a lever;

a linkage comprising:

a first pivot point;

a second pivot point movable relative to the first pivot point;

a third pivot point, the first pivot point, the second pivot point, and the third pivot point together forming an adjustable triangular shape; and a positioning feature configured to selectively fix the second pivot point in one of a plurality of positions relative to the first pivot point, the plurality of positions being different distances from the first pivot point relative to one another; and wherein the linkage is configured to transmit a mechanical compounding force to the lever, the mechanical compounding force being substantially the same regardless of the position of the plurality in which the second pivot point is fixed by the positioning feature.

2. The assembly of claim 1 wherein the lever is configured to pivot about the first pivot point.

3. The assembly of claim 1 wherein the first pivot point and the third pivot point are a fixed distance apart and the fixed distance remains the same regardless of the position of the plurality in which the second pivot point is fixed.

4. The assembly of claim 1 wherein when the second pivot point is fixed in a first one of the positions of the plurality, the first pivot point, the second pivot point, and the third pivot point form an obtuse triangle and when the second pivot point is fixed in a second one of the positions of the plurality, the first pivot point, the second pivot point, and the third pivot point form an acute triangle.

5. The assembly of claim 1 wherein the linkage is configured so that the adjustable triangular shape is manually adjustable.

6. The assembly of claim 1 wherein the lever comprises the positioning feature.

7. The assembly of claim 1 wherein the feature comprises a plurality of notches sized to receive the second pivot point.

8. The assembly of claim 1 wherein the feature comprises a first portion comprising a first plurality of teeth and a second portion comprising a second plurality of teeth sized to interlock with the first plurality of teeth, the second portion being attached to the second pivot point.

9. The assembly of claim 1 further comprising a first handle, a second handle, and an adjustment device, the first handle and the second handle being joined by a fourth pivot point and being configured to rotate in respectively opposite directions about the fourth pivot point when squeezed together, and the adjustment device being configured to automatically move the second pivot point from a first position of the plurality to a second position of the plurality when the handles are released after being squeezed together.

10. The assembly of claim 9 wherein the second position is nearer the first pivot point than the first position.

11. The assembly of claim 9 wherein the adjustment device comprises a spring.

12. The assembly of claim 1 wherein:

the lever is a first lever and further comprising a second lever;

the first lever and the second lever are both configured to rotate about the first pivot point;

one end of the first lever comprises a first surface;

one end of the second lever comprises a second surface;

the first surface and the second surface are configured to cut, grip, or clamp an object located between the first surface and the second surface when the first lever is rotated about the first pivot point in a first direction and the second lever is rotated about the first pivot point in a second direction opposite that of the first direction.

13. The assembly of claim 12 wherein the other end of the second lever comprises a first handle and further comprising a second handle moveable relative to the first handle, the second handle being configured to transmit the mechanical compounding force to the linkage when the first handle and the second handle are squeezed together.

14. A tool assembly comprising:

two jaws configured to cut, grip, or clamp an object placed between the two jaws;

two handles;

a linkage comprising:

a first pivot point;

a second pivot point movable relative to the first pivot point;

a third pivot point, the first pivot point, the second pivot point, and the third pivot point together forming a triangle; and a positioning feature configured to selectively fix the second pivot point in one of a plurality of positions relative to the first pivot point, the plurality of positions being different distances from the first pivot point relative to one another; and wherein the linkage is configured to transmit a force from at least one of the handles to at least one of the jaws, the force being substantially the same regardless of the position of the plurality in which the second pivot point is fixed by the positioning feature.

15. The assembly of claim 14 wherein the force is a compound force and further comprising a cam or gear assembly configured to create the compound force when the handles are squeezed together.

16. The assembly of claim 14 wherein the two jaws comprise bypass cutters or blade and anvil cutters.

17. The assembly of claim 14 wherein the tool is configured to open the jaws and thereby release the object when the force is removed from the at least one of the handles and to position the second pivot point in a position of the plurality in which the jaws are most fully opened compared with the other positions of the plurality.

18. A tool operation method comprising:

providing a tool comprising:

a lever;

a linkage comprising:

a first pivot point;

a second pivot point movable relative to the first pivot point;

a third pivot point, the first pivot point, the second pivot point, and the third pivot point together forming an adjustable triangular shape; and a positioning feature configured to selectively fix the second pivot point in one of a plurality of positions relative to the first pivot point, the plurality of positions being different distances from the first pivot point relative to one another; and wherein the linkage is configured to transmit a first mechanical compounding force to the lever, the first mechanical compounding force being substantially the same regardless of the position of the plurality in which the second pivot point is fixed by the positioning feature;

applying a second force to the linkage while the second pivot point is in a first position of the plurality;

subsequent to the applying of the second force, at least partially releasing the second force thereby moving the second pivot point into a second position of the plurality; and subsequent to the releasing of the second force, resuming the applying of the second force to the linkage while the second pivot point is in the second position of the plurality.

19. The method of claim 18 wherein during the applying of the second force the first pivot point, the second pivot point, and the third pivot point form an obtuse triangle and during the resuming of the applying of the second force the first pivot point, the second pivot point, and the third pivot point form an acute triangle.

20. The method of claim 18 wherein:

the tool further comprises a first handle, a second handle, and an adjustment device, the first handle and the second handle being joined by a fourth pivot point and being configured to rotate in respectively opposite directions about the fourth pivot point when squeezed together;

the applying of the second force comprises applying the second force to the linkage via at least one of the first handle and the second handle; and the moving of the second pivot point comprises moving the second pivot point using the adjustment device.

* * * * *